US011549250B1

(12) United States Patent
Barrett

(10) Patent No.: US 11,549,250 B1
(45) Date of Patent: Jan. 10, 2023

(54) FRESHWATER CONSERVATION DRAIN SYSTEM

(71) Applicant: Calvin Coolridge Barrett, Hedgesville, WV (US)

(72) Inventor: Calvin Coolridge Barrett, Hedgesville, WV (US)

( * ) Notice: Subject to any disclaimer, the term of this patent is extended or adjusted under 35 U.S.C. 154(b) by 0 days.

(21) Appl. No.: 17/859,475

(22) Filed: Jul. 7, 2022

Related U.S. Application Data

(60) Provisional application No. 63/259,757, filed on Aug. 9, 2021.

(51) Int. Cl.
*E03D 5/00* (2006.01)
*E03B 1/04* (2006.01)

(52) U.S. Cl.
CPC ..... *E03D 5/003* (2013.01); *E03B 1/042* (2013.01); *E03B 2001/045* (2013.01)

(58) Field of Classification Search
CPC .... E03D 5/003; E03B 1/042; E03B 2001/045
See application file for complete search history.

(56) References Cited

U.S. PATENT DOCUMENTS 4,112,972 A * 9/1978 Lajeuness ..... E03B 1/04 137/356
4,228,006 A * 10/1980 Hanna ..... E03B 1/04 210/167.3
5,106,493 A * 4/1992 McIntosh ..... C02F 9/00 210/100
5,147,532 A * 9/1992 Leek, Jr. ..... E03B 7/074 210/182
5,217,042 A * 6/1993 Delle Cave ..... E03C 1/122 137/357
6,969,460 B2 * 11/2005 Bertram ..... B01D 35/02 210/248
9,404,241 B1 * 8/2016 Davantes ..... F16K 27/12
10,132,083 B1 * 11/2018 Casey ..... E03B 1/044
2004/0168992 A1 * 9/2004 Ben-Amotz ..... E03B 1/042 210/167.3
2009/0222981 A1 * 9/2009 Hartman ..... F28F 1/22 4/340
2012/0199220 A1 * 8/2012 Knepp ..... E03B 1/041 137/558
2016/0115675 A1 * 4/2016 Quigley ..... E03B 1/042 700/282
2021/0010248 A1 * 1/2021 Lyons ..... E03B 1/044

FOREIGN PATENT DOCUMENTS

GB 2314580 * 1/1998 ..... E03B 1/044
WO WO95/29299 * 11/1995 ..... E03B 1/042

* cited by examiner

*Primary Examiner* — J C Jacyna
(74) *Attorney, Agent, or Firm* — Barry Choobin; Patent 360

(57) ABSTRACT

An assembly for reusing greywater in a building for flushing toilet and other purpose to save the freshwater. The assembly includes a diverter to route a portion of greywater from drainpipes to a feed line. From the feed line, the greywater is collected in a pump tank. The pump tank has a pump that can lift the greywater from the pump tank to a storage tank positioned at a top level in the building, the pump tank is at the lower level in the building. A supply line transports the greywater stored in the storage tanks to the toilet tanks for flushing the toilet bowl.

16 Claims, 13 Drawing Sheets

FRESHWATER CONSERVATION DRAIN SYSTEM

CROSS-REFERENCE TO RELATED APPLICATIONS

This application claims priority from a U.S. Provisional Patent Appl. No. 63/259,757 filed on Aug. 9, 2021, which is incorporated herein by reference in its entirety.

FIELD OF INVENTION

The present invention relates to an assembly and method for reusing greywater, and more particularly, the present invention relates to an assembly for a drainage system in a building that can reuse greywater for certain applications.

BACKGROUND

Water is precious for human life and must be saved. Besides the use of water for drinking, water is needed for a variety of purposes including domestic and industrial. Recycling of wastewater is also known, and recycled water is used for industrial purposes and the like. However, the higher costs of recycling the water are a major roadblock and countries rely on nature to recycle the water.

Thus, a need is appreciated for devices and methods that allow the reuse of wastewater in a more economical way than recycling the water.

The terms "pipe" and "line" are interchangeably used hereinafter and refers to a conduit for transporting fluid from one point in space to another point in space. The fluid can be liquid or gasses.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an assembly for reusing greywater for certain purposes.

It is another object of the present invention that the assembly can be installed in the drainage system of a building.

It is still another object of the present invention that the assembly and method of use thereof are cost-effective.

It is a further object of the present invention that the assembly can work autonomously without the need for an operator.

It is yet another object of the present invention that the assembly provides for saving a large amount of freshwater.

It is a further object of the present invention that the assembly can be used in both domestic and industrial settings.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Figure 1:
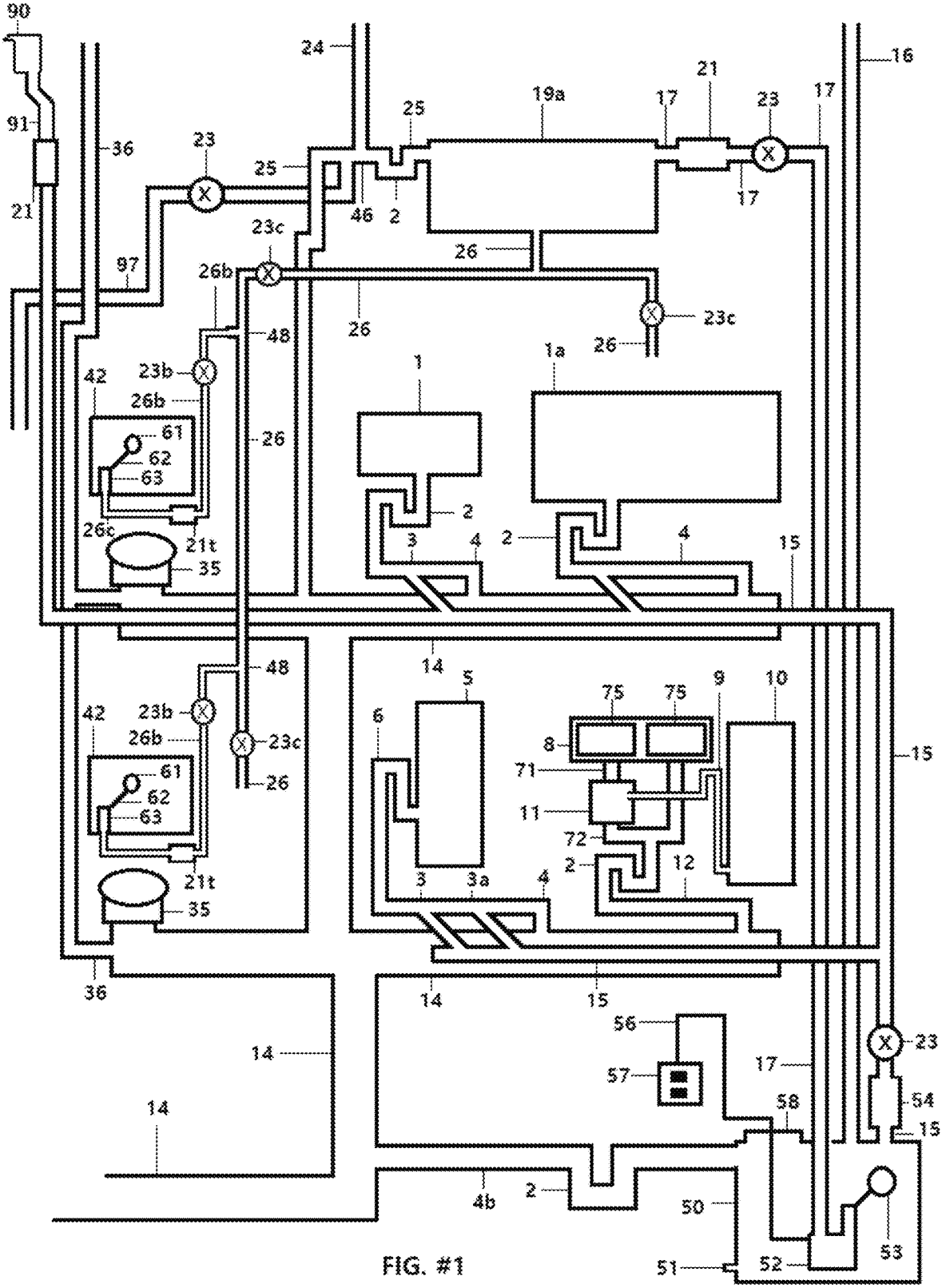
FIG. 1 is a schematic diagram of the assembly shown installed in a drainage system, according to an exemplary embodiment of the present invention.

Subject matter will now be described more fully hereinafter. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, reasonably broad scope for claimed or covered subject matter is intended. Among other things, for example, the subject matter may be embodied as apparatus and methods of use thereof. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting to embodiments of the invention. As used herein, the singular forms "a", "an", and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

The following detailed description is described with reference to the drawings, wherein like reference numerals are used to refer to like elements throughout. In the following description, for purposes of explanation, specific details may be set forth in order to provide a thorough understanding of the subject innovation. It may be evident, however, that the claimed subject matter may be practiced without these specific details. In other instances, well-known structures and apparatus are shown in block diagram form to facilitate describing the subject innovation. Moreover, the drawings may not be to scale.

Disclosed is an assembly for a drainage system in a building that allows reusing the greywater for certain applications. For example, the flushing of toilets requires a lot of water, and greywater from a different source can be used in flushing the toilets, thus saving a large amount of freshwater otherwise used in flushing the toilets. The disclosed assembly can fit into the draining system of a building and route the greywater from desired sources to the flushing units of the toilets. Any excess greywater can be safely drained into the sewer, keeping the assembly simple and economical to operate.

The greywater can be wastewater that does not include blackish water. For example, the greywater from bathing, cloth washing, hand washing, and the like can be collected for reuse. The wastewater from toilets, food, and garbage disposal units, and chemicals are referred to herein as blackish water and are not reused by the assembly.

The disclosed assembly can include a Tee Wye or a Y or a Tee pipe fitting to collect the greywater. The assembly can include standard plumbing pipe(s) and fittings, shut-off valves, and connectors. Tee-Wye pipe fitting can be installed in a drain-line, past fixture's drain traps. Fittings T -Y, Y-T, or T's angle is turned down into the second set of drain pipe(s), Installed past drain trap(s) separate from the building's drain system. Balance of all greywater, not gravity fed at Tee Wye is run straight back into sewer drain from straight side of the Tee Wye, Y-T, T's fitting. Fittings can be installed with the fitting angled down to capture greywater. Tee Wye captures the largest percentage of water inflow. This is now the gravity-fed greywater pipeline.

The assembly can further include gravity-fed wastewater pump tanks that can be placed at the lowest levels in a building, such as in a crawlspace or a basement of the building. The assembly can further include a pump and a control circuit for the pump that can turn the pump on as the pump tank is filled and turned off when the pump tank is empty. The assembly can further include storage tanks that can be positioned in a building at a level above the toilets to be flushed. The greywater collected in the pump tank can be pumped by the pump into the storage tanks. The assembly can further include suitable filters to trap any solid residue in the greywater. The pump tanks can be of high capacity, for example, the size of the pump tank can be based on daily water consumption. Also, instead of having one large tank, several tanks can be provided connected in series. Similarly, a large-size storage tank or several small-size storage tanks can be provided in series. Each pump tank can have an inlet for receiving greywater, a first outlet connected to the pump, and a second outlet that can be connected to a sewer line or another tank. Also, the assembly can include a P or S trap at the second outlet connected to the sewer line to prevent the ingress of sewer gasses into the disclosed assembly. Using suitable pipes, the greywater in the storage tanks can be connected to toilets wherein the water from the storage tanks can be gravity-fed to the toilets. The toilet's feed pipe(s) can be larger at the overhead tank and can be reduced in size before connecting to the toilet unit. Piping to toilet tank(s) could be at a minimum one size larger than required by code to any standard toilet. Optionally a ¾" or larger float valve can be used in the toilet. Any standard float valve in the toilet can be replaced with a larger (throat) in-flow float valve. The larger size valve can provide a faster flow rate and quicker filling of the tank of the toilet. However, it is understood that the disclosed assembly can work with any float valve, such as a standard float value used in toilets. The float valve can be sealed with a rubber gasket to the inside tank, and bolted to the storage feed line with a threaded nut, from the outside of the tank. The larger size float valve can allow small debris including hairs and lint to pass through preventing any blockage.

The Tee pipe fitting, Tee Wye Pipe Fitting, Wye Tee Pipefitting, or the Tee Wye pipe fitting of a larger size than the drainpipe can be used. Alternatively, a long gated or a long sweep Tee Wye pipe fitting can be used. Or Tee pipe fittings Double Tee, Wye, and/or Tee Wye Pipe Fitting set in series can be helpful to capture additional greywater. Pipe reducers can be used to seal different size pipes together.

Separate air venting can also be provided in addition to standard air vents. For example, placing a vent pipe at top of pump tank(s). The additional air venting can ensure no vacuum problems when in use.

In certain implementations, the rainwater run-off from gutters can be piped into the disclosed assembly, however, suitable filters can be used to trap any debris, before the rainwater enters the drainpipes.

In certain implementations, a shut-off valve with a Tee fitting can be installed at the drainpipe installed at top of the storage tank before it is returned to the building sewer drain. This can be used to run grey water overflow outside for agricultural use, and or general cleaning or equipment.

In certain implementations, the straight part of the T-Y fitting can allow any greywater not captured for filling storage tank(s) to be run straight into the sewer system, and if a blockage occurs in the feed line, the greywater can flow straight into the drainage system of a building.

In certain implementations, the pump can be powered by the main power supply, solar panel, wind energy, batteries, and the like.

In certain implementations, the disclosed assembly can be made functional by the installation of drainpipes, which are sized to match the drainpipes of fixtures in the building. All local plumbing codes can be enforced with the installation of disclosed assembly. This includes, but is not limited to, the horizontal grade drops in the drain line, (flow rate of water in drainpipes), connections of pipes, tanks, pump fittings, drain traps, air venting of system, and types of material plumbing parts that are made of. Local plumbing codes are to be enforced with the style also of installation of greywater systems.

With exception of installing fittings/diverters used to capture greywater from the drains and routing the greywater into the feed lines of the assembly, the greywater can flow under gravity from the drainpipes to the feed lines. The diverters can be T or Y fittings installed upside down. The diverters used can be long gated or long sweep Tee-Wye, long gated or long sweep Wye-Tee, Tee, Wye, T, Y pipe fittings. All aforementioned fittings will capture greywater from one drain and feed the greywater into another feed line both connected to the fitting/diverter. The long sweep Tee-Wye can remove the largest amount of greywater. This was measured at a drop rate in the pipe from 1/16 inch per linear foot to 1/8 inch per linear foot. This water gravity feed flow rate is standard in most drain systems.

A pump tank can be connected to the feed line for receiving the greywater, and the pump tank can be positioned in the basement or a crawlspace in the building. The pump tank can be sealed at the top or can have a removable lid.

The pump tank can have an inlet for receiving the feed line, an outlet for the vent pipe, another outlet for the pump line that carries greywater from the pump tank to the storage tank, and another outlet for the overflow line that can remove excess greywater from the pump tank into sewer lines. Suitable shut-off valves can be provided at desired places in the pipelines to control the flow of greywater.

Any pump (like but not necessarily a sump pump) which is capable of turning itself on as the tank fills and off when the tank is empty of greywater can be used. The pump can be installed in the pump tank. Pump operates most efficiently in a system when vertical discharge pressure-head is rated just above highest installed storage tank in recycle system, and pressure-head is rated below air vent(s) pipeline(s) tallest height. The pump pipe can be installed on the stated pump. The storage tanks are installed above the toilets. Pumps operate efficiently when the vertical discharge "pressure-head" is rated just above the highest installed storage tank. The lowest pressure of pump needed when lifting greywater to storage tanks is easiest on total recycle system and building drain and or sewer lines.

When greywater storage tanks are full, the excess greywater can be routed to the sewer lines using suitable overflow lines that connect to the sewer lines. The overflow lines can be provided with gas traps, such as S or P drain traps to prevent the ingress of sewer gasses.

Suitable inline filters can also be provided at different points in the assembly. The in-line filters can be installed in pipes and can be removed for cleaning and maintenance. The first and largest filter can be located at the feed line just before the pump tank. The inline filters can be installed using any removable form of pipe connector repair fittings. Fitting must be sized to work with the pipes in the building's drain system. Reducers can be used for sealed connections between the filter unit(s) and pipe connections. Being the first filter and treatment of water, it can collect the majority of debris including hairs from the greywater. Each of the inline filters can be provided with a pre-screening basket that can capture debris and hair and could be easily washed. The inline filters can include compartments for treatment agents, wherein greywater could pass through the compartment and get treated. Examples of such treating agents include chlorine tablets.

In certain implementations, the installation of any or all aforementioned diverters/pipe fittings (T's, Y's, etc.) in multiples can be used to capture greater amounts of greywater. Additional or larger fittings may allow more volume of the greywater running in the drain pipes captured by the diverters.

Referring to FIG. 1 shows the assembly installed in a drainage system of a building, such as a household. FIG. 1 shows a first source 1 of greywater that can be hand sinks, bathroom sinks, or any fixture not resulting in black water or garbage in wastewater. A second source la of greywater can be a bathtub or shower. A third source 5 of greywater can be a washing machine for clothes. FIG. 1 also shows a drain trap 2, such as a P or S drain trap that can block the ingress of sewer gasses. The third source 5 can be connected to a drainpipe 6 for carrying greywater to sewer.

A diverter 3 can be installed in the standard drainpipes from the wastewater source to divert the greywater or a portion of the greywater to a tank of the disclosed assembly. In one implementation, the diverter can be Tee Wye Fitting as shown in FIG. 1. A Tee Wye Fitting (long sweep) with 45 deg. turned down is shown in FIG. 1 which can efficiently deliver most of the greywater into the tank of the disclosed assembly. A few examples of the diverters are, but are not limited to, Long Sweep Wye Tee, T Y, T, and Tee Wey Fitting.

The standard drainage pipeline 4 after the diverter 3 can merge into the common sewer line 14 that ends in a sewer. The greywater not captured by diverter 3 can continue flowing into sewer lines 14 to the sewer. Diverter 3 can be connected to a feed pipe 15 of the disclosed assembly. The greywater collected by the diverters can be routed into the feed pipe 15. The feed pipe 15 can be connected to a pump tank 50 which collects the greywater. As shown in FIG. 1, the feed pipes can run within the standard sewer lines of the building. This may allow easier installation of the disclosed assembly and also the retrofitting of the disclosed assembly in existing sewer lines of the drainage network.

Figure 8:
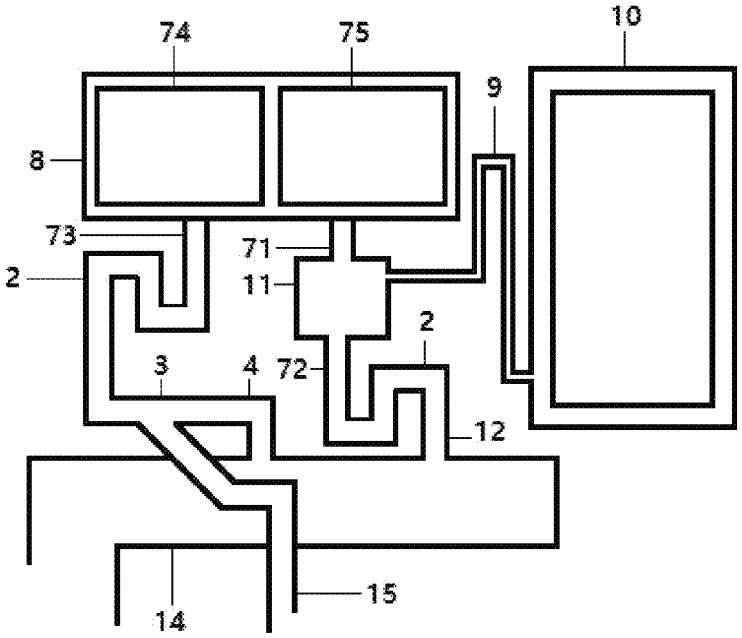
FIG. 8 shows a kitchen sink having two sinks and a drain pipe from one sink connected to a feed line of the assembly for receiving the greywater, according to an exemplary embodiment of the present invention.

A kitchen sink 8 is also shown in FIG. 1 which can be connected to a garbage disposal unit 11. Because of the food debris, the wastewater from the kitchen sinks may not be reused by the disclosed assembly. The drainage pipe 12 from the kitchen sink and the food disposal unit 11 can direct all the wastewater to the sewer lines. Element 71 shows any standard plumbing connection, used to seal the kitchen sink at spin and grind to the garbage disposal. Element 72 is a standard pipe connection used to connect the bottom of the garbage disposal to the building's drain. Element 75 in the kitchen sink can be kitchen bowls/sinks. Adjacent to the kitchen sink 8 is also shown a dishwasher 10 and a drainage pipe connects the dishwasher 10 to the food disposal unit 11. Such water containing food debris from the kitchen sinks or food disposal unit can be considered blackish water and may not be suitable for reuse, and thus can be discarded as such directly to the sewer lines. FIG. 8 shows the splitting of the double bowl kitchen sink, the two bowls have separate sink drains and the one without food garbage can be connected to the disclosed assembly for reusing the greywater. FIG. 8 shows the kitchen sink 8 which has a first bowl 74 and a second bowl 75. Drain line 73 extends from the first bowl 74 and includes a trap 2 of gases. The diverter 3 connects to the drain line 73 for capturing the greywater from the sink bowl 74. Another drain line 71 can connect the second bowl to the garbage disposal unit 11.

The diverter 3 which is shown as a Tee Wye in FIG. 1 is installed in an inverted position so that water from the standard drainage pipe can flow under gravity into the feed pipe 15 of the disclosed assembly. The end of feed pipe 15 connects to pump tank 50 which collects the greywater from different wastewater sources. The pump tank 50 is shown at bottom of the diagram to illustrate that the pump tank 50 can be positioned at a lower level in the building, such as in a basement. Preferably, the pump tank 50 can be at least below the lowest wastewater source in the building. This is because the greywater can flow from the wastewater source into the pump tank freely under gravity. An overflow line 4*b* is also shown in FIG. 1 extending from the top of the pump tank. The overflow line 4*b* can connect the inner volume of the pump tank to the sewer line. The overflow line 4*b* can ensure that any excess greywater entering the pump tank can flow out into the sewer line and prevent any overflow of greywater in the pump tank. The overflow situation can arise when the pump may not work properly or suddenly a huge amount of greywater gushes into the pump tank. The trap 2 is critical in the overflow line to prevent the ingress of sever gasses.

The assembly can also include a vent pipe 16 that extends from the top of the pump tank to remove any gasses and prevent the formation of a vacuum in the pump tank. The vent pipe can extend out from the building to exhaust the gasses into the atmosphere. Alternatively, the vent pipe 16 can connect to an already installed venting assembly in a building. such venting tubes can be provided at different points in the assembly, such as in the feed line, overflow line, storage tanks, and the like to remove any gasses and prevent vacuum buildup.

The bottom of the pump tank 50 can be provided with a drain plug 51 that can be opened to empty the pump tank for cleaning and maintenance. The drain plug 51 can be a threaded drain plug that can be sealably fastened into a threaded aperture in the wall of the pump tank. A shut-off valve 23 can also be provided in the feed line 15 just before connecting to the pump tank, wherein the shut-off valve can be used to block the flow of water into the pump tank. The shut-off valves can be provided at different points in the assembly to control the flow of water within the assembly and between the assembly and drainage system of the building. The shut-off valve can be turned between an on-position in which water can pass through the shut-off valve, and the shut-off valve can be switched to an off-state in which fluid cannot pass through the shut-off valve.

The assembly can also include a pump for lifting water from the pump tank to a storage tank positioned at a height from the pump tank. FIG. 1 shows a pump 52 mounted inside the pump tank 50. Pump 52 shown in FIG. 1 is a sump pump, but any type of pump or similar device known for lifting water can be used without departing from the scope of the present invention. Pump 52 can have a shut-off float valve 53 that can detect a level of water in the pump tank. Based on the level of water in the pump tank, the shut-off float valve 53 can start and stop pump 52. The pump 52 can be powered by electricity from a main switch 57 connected by an electrical cord 56. The output of the pump 52 can be connected to pump line 17 (pipe) which opens in storage tank 19*a*. the gray water in the pump tank can be lifted to the storage tank by the pump and through the pump line.

Figure 7:
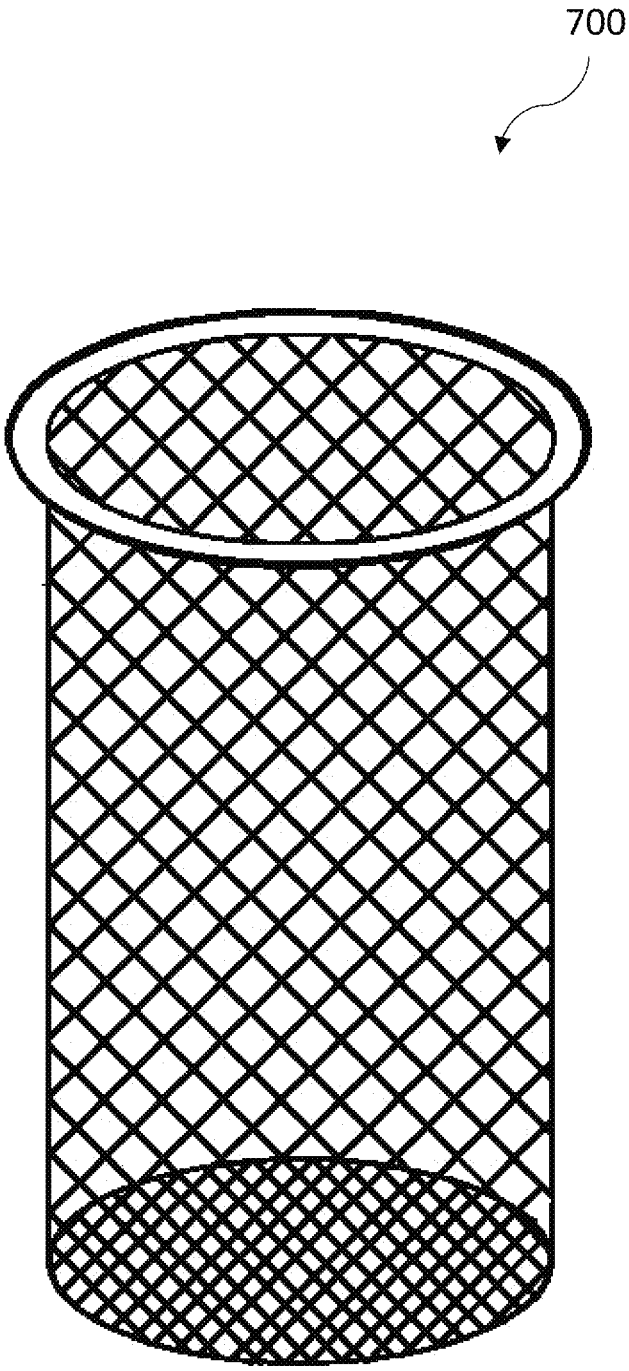
FIG. 7 shows a mesh basket of the inline filter, according to an exemplary embodiment of the present invention.

The assembly can also include an inline filter 54 installed in feed line 15. The inline filter 54 can trap any debris in greywater and prevent the debris from reaching the pump tank. The inline filter can be removable for cleaning and replacement. FIG. 1 shows the inline filter 54 installed between the shut-off valve 23 and a joint of the feed line and the pump tank. Suitable coupling, such as a repair compression coupling can be used to install the inline filter into the feed line. The inline filter can be of a higher capacity to allow a faster flow rate and prevent frequent maintenances. For example, a two inches feed pipe can be provided with three inches inline filter. The inline filter can provide for multiple steps water cleaning and treatment process. A pre-cleaning mesh basket can be provided that removes larger debris and hairs. The pre-cleaning mesh basket can be easily removed, and the deposited debris can be disposed of. The mesh basket has a long life and is easier to clean and maintain. In certain implementations, the mesh basket can be removed without disassembly of the whole inline filter. FIG. 7 shows a basket 700 that can be used with the inline filter. The inline filter can include other filtration layers for removing smaller size debris that could have passed the mesh basket. However, any such filtration layer can be coarse so that the flow rate of water is not affected significantly. The inline filter can also include a compartment that can receive a water-treating agent, such as chlorine, wherein the water passing through the inline filter can be disinfected by the agent. such inline filters can be provided at different points in the disclosed assembly.

The storage tanks can store the greywater for use in the toilets. The storage tanks can be positioned at a height in a building such as in the attic. The storage tank can be at least above the highest toilet in the building so that greywater from the storage tank can flow under gravity into the toilet. FIG. 1 shows a single pump tank and a single storage tank; however, more than one pump tank and more than one storage tank are within the scope of the present invention. The storage tank can be mounted to a wall above the toilet tank. Moreover, the capacity of the storage tank and the pump tank can be varied without departing from the scope of the present invention. An inline filter 21 and a shut-off valve 23 can also be provided for the storage tank, however, it can be optional. A vent pipe 24 can also be provided for the storage tank. The vent pipes can prevent the build-up of pressure, vacuum, or blockage in lines & tanks due go gasses and thus, the vent pipes can be provided at areas of the assembly that are susceptible to pressure build-up, vacuum, or blockage such as tanks. The vent-up pipes may not be critical but the assembly without suitable arrangement of vent pipes may slow down. A Tee Fitting 46 can be used to vent past the tank drain trap. Installation of S and P traps are standard and used for vacuum control of drain systems. The pipes of the assembly can be matched to the drain system in the building. An overflow line 25 can also be provided for the storage tank that can connect with the sewer lines and remove excess water in the storage tanks to the sewer lines. An outlet can be provided at the bottom of storage tank 19*a* that can be connected to a supply line 26.

In one case, supply line 26 can be of a larger diameter than standard pipelines used in the drainage system of a household. The large diameter supply line 26 can provide for a better water flow rate and thus, faster filling of the toilet tanks. Open-end branches can are also shown in the supply line that allows adding more toilets, wherein the open-ends can be temporarily closed using shut-off valves 23*c*, and the like. The supply line can form a network of branches to connect to more than one toilet in a building. Pipeline 26*b* can connect supply line 26 to the tank of the toilet. Pipeline 26*b* can be narrower than supply line 26. A T-joint 48 can be seen in FIG. 1 which allows pipeline 26*b* to connect to the supply line 26. Pipeline 26*b* can also be provided with shut-off valves 23*b* to stop the flow of water into the toilet tanks. An inline filter 21*t* can also be provided for pipeline

26*b* which can be based on a standard pipe repair compression coupling. The inline filter 21*t* can be installed before connecting to the toilet.

FIG. 1 shows a toilet bowl 35 that is connected to the sewer line and a vent pipe 36 can also be seen extending from the sewer line. Above the toilet bowl can be seen a standard toilet tank 42 that can store water for flushing the toilet bowl. The inlet of the toilet tank can be connected to the supply line 26*b* through a float valve 63. Preferably a larger float valve can be used than a standard float valve fitting, wherein a larger float valve may allow a better flow rate, and any debris can pass through without blocking the float valve. A narrower pipe 26*c* which has a diameter less than pipe 26*b* can connect to float valve 63 to the inline filter 21*t*. A round float 61 and a rod 62 connect the round float 61 to the float valve 63. The float valve can be made of PVC or brass and can have a size of about ¾" or more. An enlarged float valve and increased pipe size from standard ⅜ in and ½ inches pipe to a minimum ¾ inch as a supply line to the toilet tank allows water to flow at a faster rate under gravity only.

FIG. 1 also shows a gutter system 90 installed in the building. Rainwater can also be fed to the disclosed assembly as greywater. A downspout 91 or a gutter drain piping can join the gutter to a gutter inline filter 21. The gutter line filter can remove any debris from the rainwater, such as leaves and sand. FIG. 1 also shows an additional line 97 extending from the storage tank 19*a* that can be used to supply the greywater from the storage tank for other purposes such as watering the plants and the like. A shut-off valve 23 can also be provided in the additional line 97.

Figure 2:
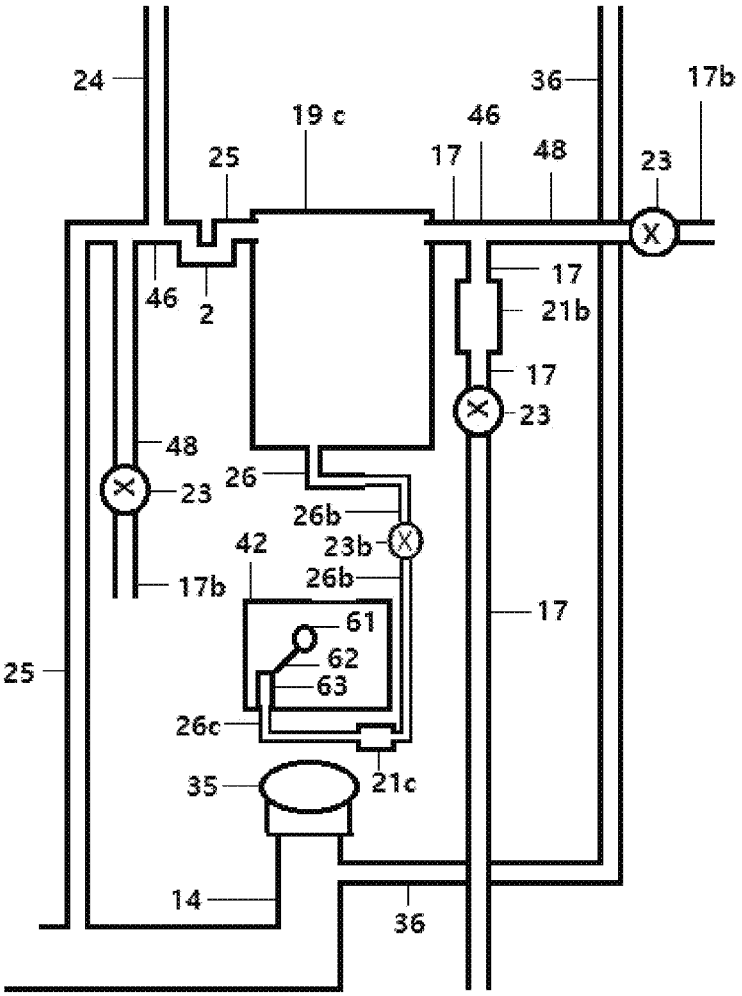
FIG. 2 shows another embodiment of the assembly that allows the use of greywater for additional purposes, according to an exemplary embodiment of the present invention.

Referring to FIG. 2 shows a variation in the storage tank. FIG. 2 shows the storage tank 19*c* that can be installed on a wall. An extra line 17*b* is also shown in FIG. 2 which can allow adding additional storage tanks, wherein line 17*b* can supply water from the first storage tank to the next storage tank in a series. The spare line 17*b* can route water from pump line 17 for additional uses, such as watering grounds outside and/or for clean-up outside. supply line 26*b* can be narrower than supply line 26, such as reduced to a minimum ¾" standard pipe. Supply line 26*c* can be a ⅜ inches to ½ inch pipe, but a minimum of ¾ inches pipe works best.

Figure 3:
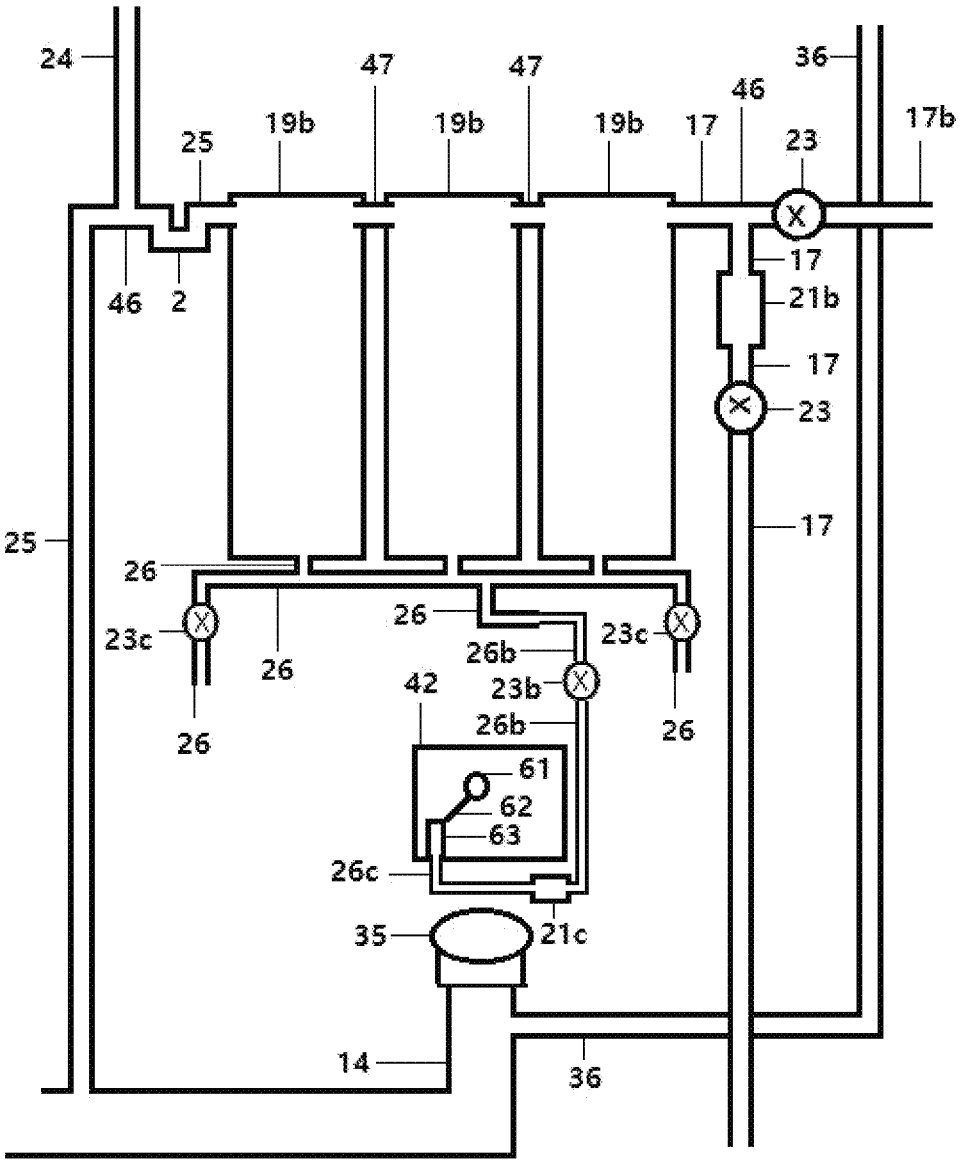
FIG. 3 shows another embodiment of the assembly having multiple storage tanks connected in series, according to an exemplary embodiment of the present invention.

FIG. 3 shows a series of three in-wall-mounted storage tanks 19*b*. It is understood, however, that the storage tanks can be mounted over the wall as well, without departing from the scope of the present invention. Line 47 connects the three storage tanks 19*b*, wherein line 47 is positioned at the top of the three storage tanks. The first storage tank in the series can be provided with a pump line 17 from the pump tank 50. The first storage tank can be filled first, and upon being filled, the water through line 47 can flow into the adjacent storage tank. The process can be repeated until all the storage tanks in series are filled. A standard pipe connection Tee Fitting 46 that is installed standard to code, here used to connect air vent pipe past tank drain trap. The air vent pipe is used for vacuum control in drain systems and blocks out sewer gas from the system.

Figure 4:
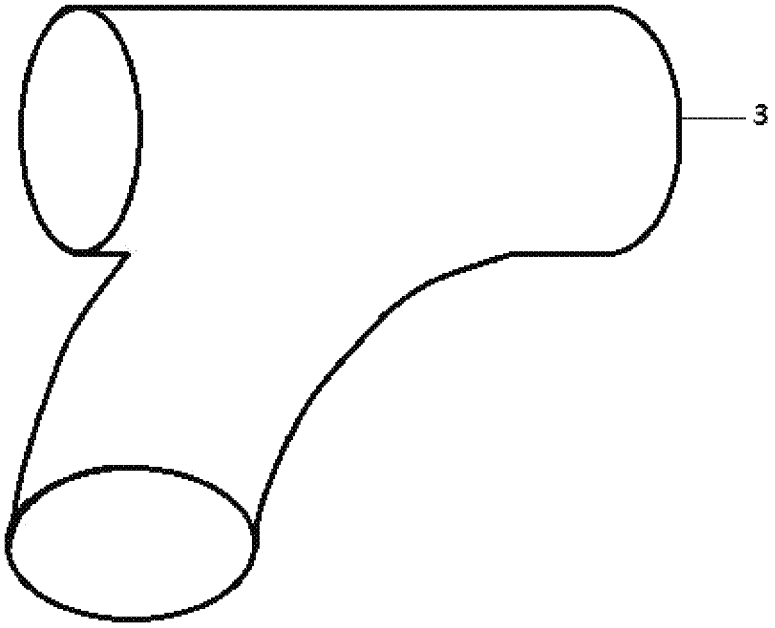
FIG. 4 shows a Tee-Wye fitting of the assembly, according to an exemplary embodiment of the present invention.
Figure 5:
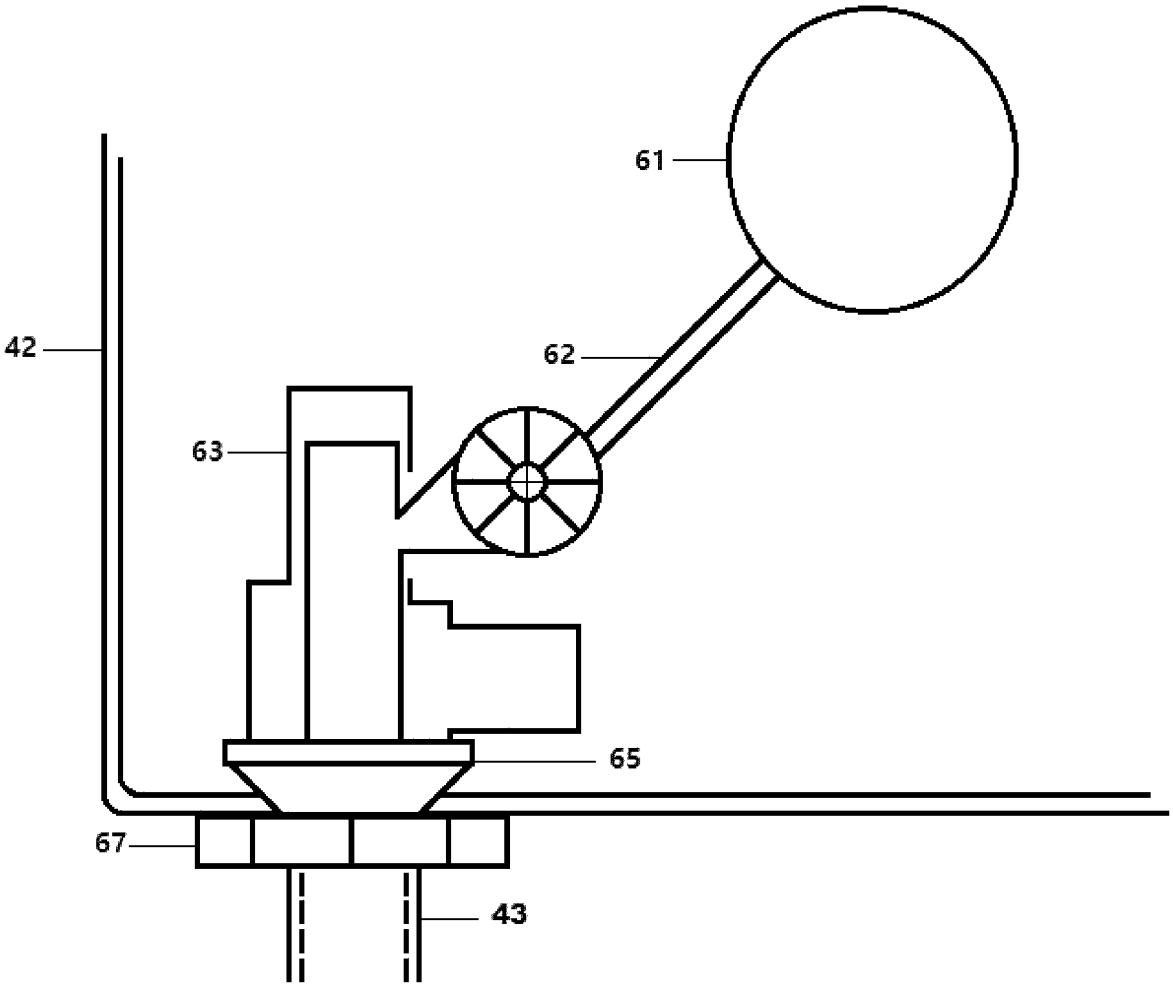
FIG. 5 shows a larger throated float valve installed in a standard toilet, according to an exemplary embodiment of the present invention.
Figure 6:
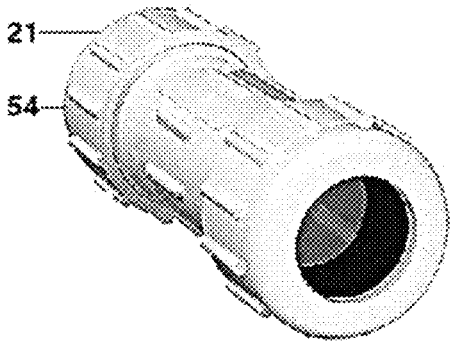
FIG. 6 shows one of many different pipe repair fittings used for access to the in-line filter basket of the assembly, according to an exemplary embodiment of the present invention.

FIG. 4 shows an exemplary embodiment of the Tee-Wye fitting. FIG. 5 shows an enlarged view of toilet tank 42. A taper rubber washer 65 is also shown installed to seal the tank float valve, at an orifice. Tapered rubber washer used as a standard seal of the tank to float valve. Seals tank to and around valve at threaded nipple at bottom of the water tank. A pipe thread nut 67 can be used to install and hold the float valve to the water tank of the toilet. A threaded pipe connection 43 can connect the float valve to the pipe feed line. FIG. 6 shows an exemplary embodiment of the PVC pipe repair couple 54 and 21, one of many different pipe repair fittings which can be used for access to the inline filter basket. The pipe repair compression coupling 21, the grey water tank is sized for the pipe. Tank filter uses couples. PVC pipe repair couples are one of many different pipe repair fittings which can be used for access to the inline filter. An over-sized pipe repair compression 54 is shown coupled to the pipeline to allow greywater to run gravity-fed at a faster rate through the filter into the tank with minimum maintenance and cleaning needs. PVC pipe repair couple is one of many different pipe repair fittings which can be used for access to the inline filter basket.

Figure 9:
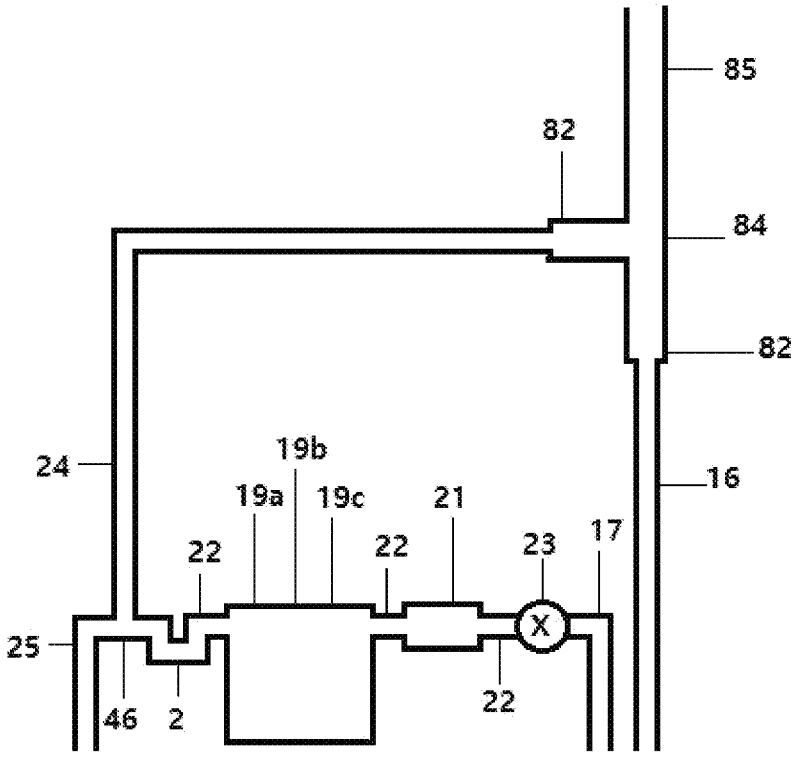
FIG. 9 shows a common vent pipe for a larger diameter that connects to other vent pipe, according to an exemplary embodiment of the present invention.

Refer to FIG. 9 which shows the coupling of the vent pipe 16 from the pump tank and the vent pipe 24 from either storage tank 19*a* or 19*b* or 19*c*. A standard pipe tee 84 having a branch 82 and 85 can connect the two vent pipes. The branches 84 and 85 can be of larger diameter than the vent pipes 16 and 24. Different vent pipes of the assembly and/or drainage system can be connected as shown in FIG. 9

Figure 10:
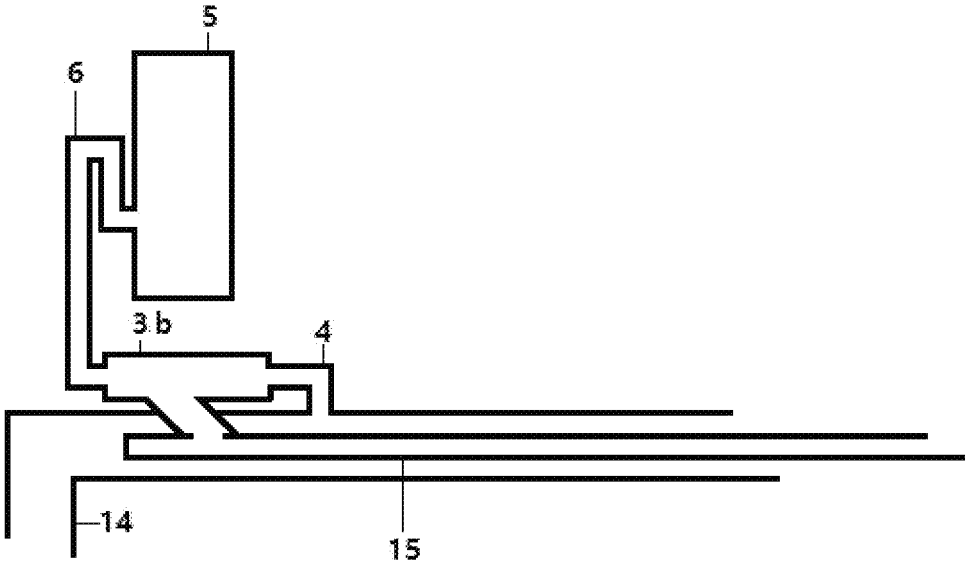
FIG. 10 shows a diverter of larger size that can capture more greywater from the washing machine, according to an exemplary embodiment of the present invention.

FIG. 10 shows an embodiment of the diverter 3*b* which is larger than the diverter 3 shown in previous drawings. The larger size of the diverter can capture more water and route more water from drainpipe 6 of wastewater source 5 to feed line 15 of the disclosed assembly. The larger size diverter can be particularly useful for wastewater sources that can produce a lot of wastewaters in a short duration, such as washing machines.

Figure 11:
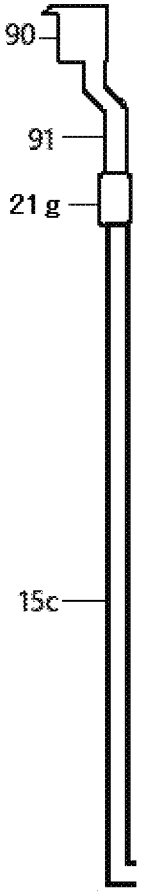
FIG. 11 shows gutter run-off and in-line filter, according to an exemplary embodiment of the present invention.

FIG. 11 shows an embodiment of the building gutter run-off being routed through an additional filter(s) and fed into the pump tank of the disclosed assembly through a feed line 15*c*. The downspout 91 connects the gutter system 90 to an inline filter 21*g* that can be removable for cleaning and can remove any debris in the rainwater and prevent the debris from reaching the pump tank.

Figure 12:
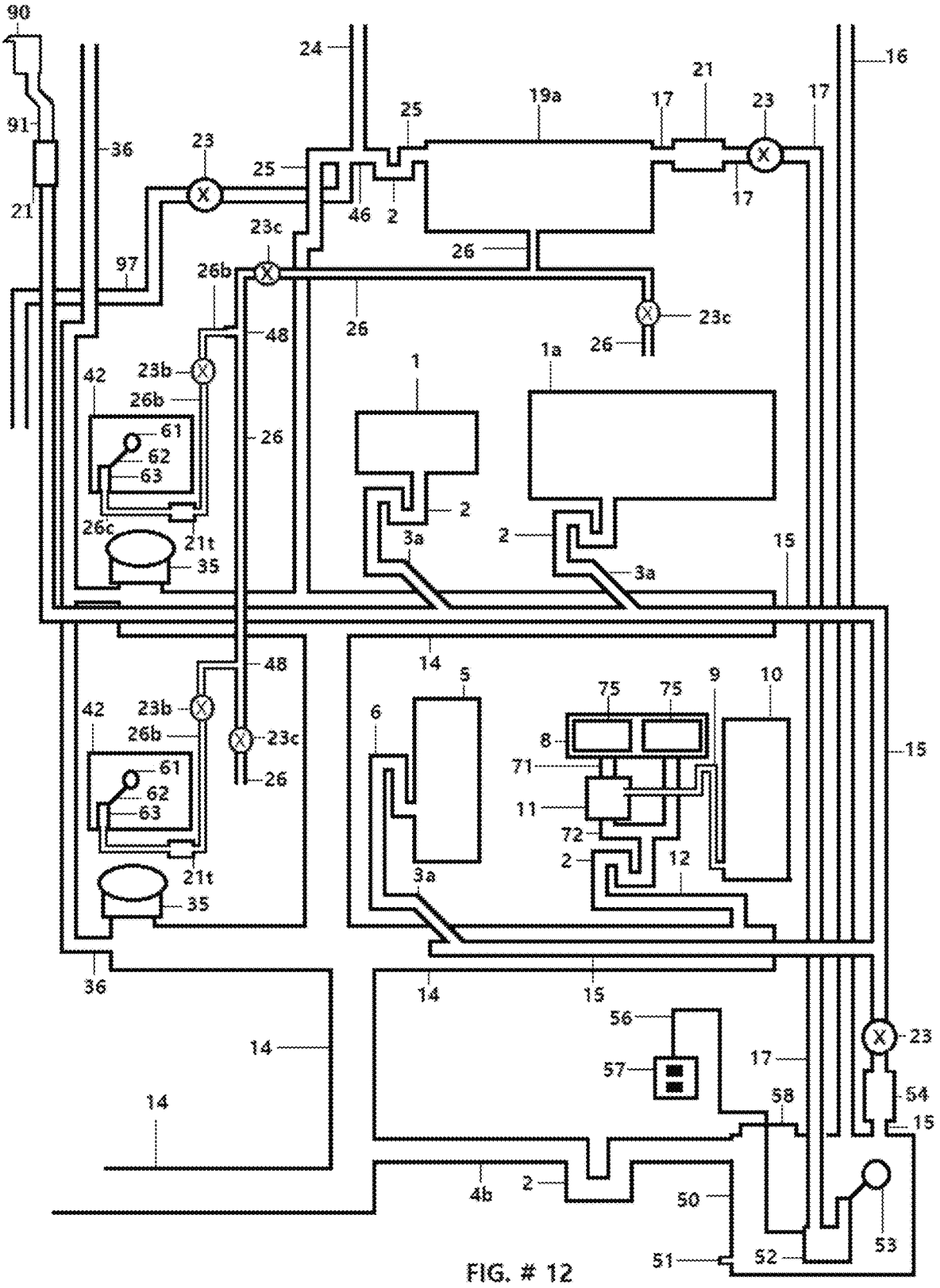
FIG. 12 shows another embodiment of the assembly in which the diverters are omitted and drainpipes from the wastewater sources are directly connected to the feed line, according to an exemplary embodiment of the present invention.

FIG. 12 shows an alternate embodiment of the assembly in which the greywater from the wastewater source is directly fed to feed line 15 through drainpipe 3*a*. The drainpipe 3*a* from the wastewater source is directly coupled to the feed line 15 and no greywater flows to the sewer lines. The overflow line 4*b* herein becomes critical for allowing an excess of greywater in the pump tank to flow to the sewer lines. The need for the diverter can be omitted by directly connecting the drainpipe to the feed line 15. Trap 2 can prevent the ingress of sever gasses into the assembly. It is preferably to provide any trap that can prevent the ingress of gasses.

Figure 13:
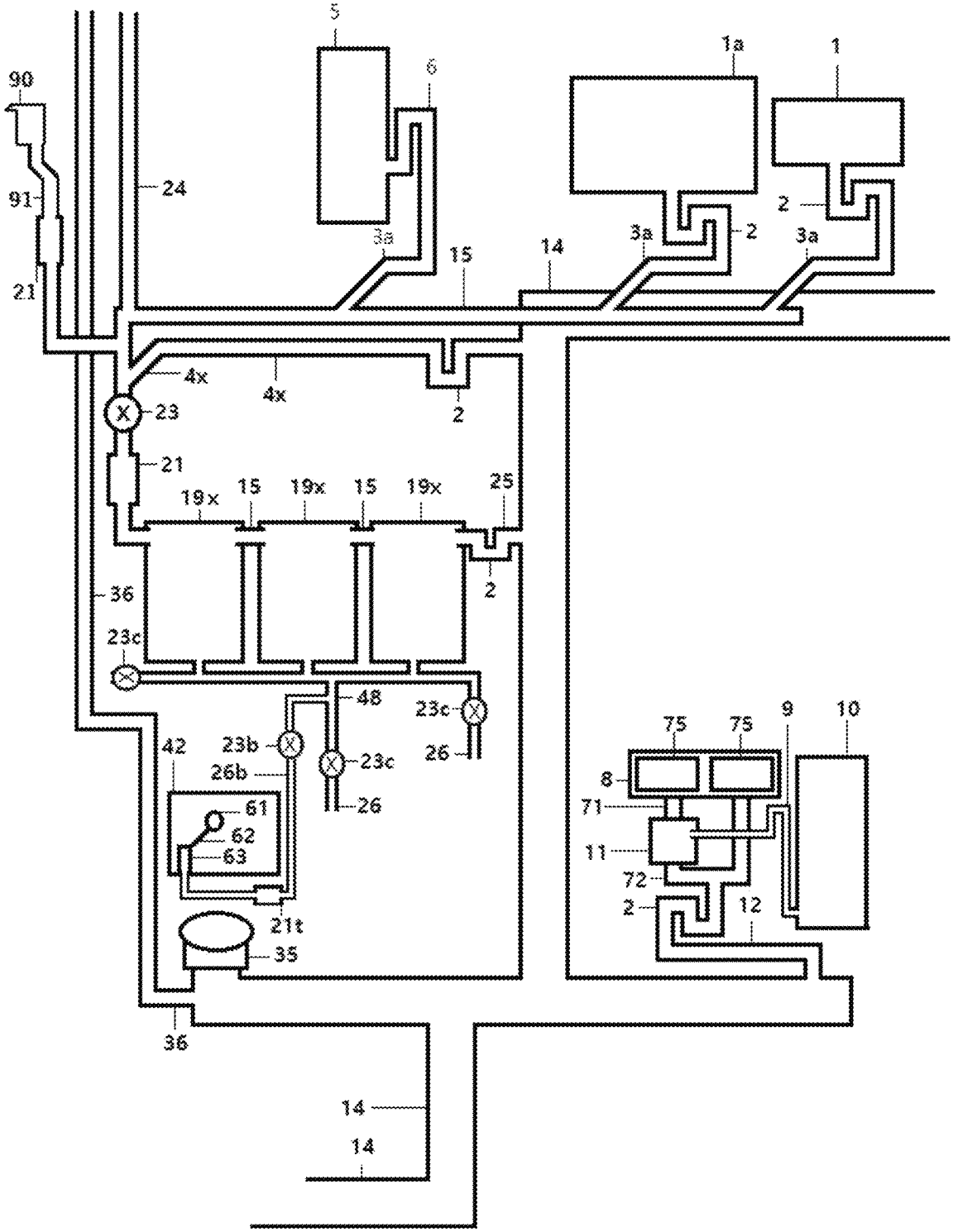
FIG. 13 shows another embodiment of the assembly in which pump tanks and the pump can be omitted and the greywater can be directly fed to the storage tanks and from the storage tanks to the toilet, according to an exemplary embodiment of the present invention.

FIG. 13 shows an alternate embodiment of the disclosed assembly in which the pump tanks can be omitted. In buildings in which the wastewater source is located on the top levels of the building and toilets are at the bottom levels, the feed lines can directly enter the storage tanks and supply lines from the storage tanks can be fed to the toilets. FIG. 13 shows three storage tanks 19*x* connected through the feed line 15. A shutoff valve 23 can be provided in the feed line to stop the flow of greywater to the waste tanks and divert the greywater to sewer lines through the bypass line 4*x*. Supply line 26 can deliver the greywater from the storage tanks to the toilet under gravity without the need of any pumps as described above and details are not repeated here. The need for electricity by the assembly can be avoided in building wherein the sources of grey water are located above the toilets. Both the pumps and pump tanks may not be needed and the gray water can be directly stored in tanks in each toilet.

Different features, variations, and multiple different embodiments have been shown and described in various detail. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations, and other embodiments will come to mind of those skilled in the art, and which are intended to be and are covered by this disclosure. It is indeed intended that the scope of this disclosure should be determined by a proper legal interpretation and construction of the disclosure, including equivalents, as understood by those of skill in the art relying upon the complete disclosure present at the time of filing.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An assembly for reusing greywater in a building, the assembly comprises:

a feedline configured to transport greywater, the feedline configured to be installed within a sewer line;

a first diverter configured to connect a first drainpipe to the feedline and the sewer line the first drainpipe connects to a first wastewater source;

a second diverter configured to connect a second drainpipe to the feedline and the sewer line, the second drainpipe connects to a second wastewater source, wherein the second wastewater source produces a significantly larger volume of wastewater in a given duration, wherein the second diverter is larger in size than the first diverter, wherein the first diverter and the second diverter are Tee wye pipe fitting;

a pump tank, the pump tank has an inlet connected to the feed line for receiving the greywater;

a pump configured to pump the greywater in the pump tank, wherein an output of the pump is connected to a pump line;

a storage tank coupled to the pump line and is configured to receive the greywater from the pump through the pump line; and a supply line that extends from the storage tank and configured to transport the greywater into a toilet tank, wherein the greywater is used for flushing a toilet bowl.

2. The assembly according to claim 1, wherein the pump is installed within the pump tank, the pump has a shut-off float valve configured to detect level of greywater in the pump tank.

3. The assembly according to claim 1, wherein the assembly further comprises:

a first overflow line that extends from a top portion of the pump tank and configured to remove excess greywater entering the pump tank, wherein the first overflow line is connected to a sewer line, and the excess greywater flows into the sewer line.

4. The assembly according to claim 3, wherein the assembly further comprises:

a second overflow line that extends from a top portion of the storage tank and configured to remove excess greywater entering the storage tank, wherein the second overflow line is connected to a sewer line, and the excess greywater flows into the sewer line.

5. The assembly according to claim 1, wherein the assembly further comprises a first inline filter installed in the feed line just before the pump tank, the first inline filter configured to trap debris in the greywater entering the pump tank.

6. The assembly according to claim 5, wherein the first inline filter further comprises a pre-mesh basket configured to trap debris of larger size.

7. The assembly according to claim 6, wherein the first inline filter is further configured to disinfect the greywater passing through the first inline filter.

8. The assembly according to claim 7, wherein the assembly further comprises a second inline filter in the pump line for filtering the greywater entering the storage tank.

9. The assembly according to claim 4, wherein the assembly further comprises a first vent pipe that extends from a top of the pump tank.

10. The assembly according to claim 9, wherein the assembly further comprises a second vent pipe that extends from the second overflow line.

11. The assembly according to claim 4, wherein the assembly further comprises a first gas trap installed in the first overflow line.

12. The assembly according to claim 11, wherein the assembly further comprises a second gas trap installed in the second overflow line.

13. The assembly according to claim 1, wherein the feed line is configured within the sewer line of the standard drainage system.

14. The assembly according to claim 1, wherein the assembly further comprises a plurality of shut-off valves in the feed line, the pump line, and the supply line for controlling a flow of greywater.

15. The assembly according to claim 1, wherein the assembly further comprises a second supply line that extends between the toilet tank and the supply line, wherein a diameter of the second supply line is less than a diameter of the supply line.

16. The assembly according to claim 1, wherein the first wastewater source is a bathroom, and the second wastewater source is a washing machine.

* * * * *